US012687375B2

(12) United States Patent
Oostvogel

(10) Patent No.: US 12,687,375 B2
(45) Date of Patent: Jul. 21, 2026

(54) BALLISTIC SHIELD

(71) Applicant: POINTMAN ARMOR CONCEPTS B.V., Amsterdam (NL)

(72) Inventor: Abraham Alexander Frederic Oostvogel, Amsterdam (NL)

(73) Assignee: POINTMAN ARMOR CONCEPTS B.V., Amsterdam (NL)

( * ) Notice: Subject to any disclaimer, the term of this patent is extended or adjusted under 35 U.S.C. 154(b) by 9 days.

(21) Appl. No.: 18/718,213

(22) PCT Filed: Dec. 12, 2022

(86) PCT No.: PCT/NL2022/050714
§ 371 (c)(1),
(2) Date: Jun. 10, 2024

(87) PCT Pub. No.: WO2023/113595
PCT Pub. Date: Jun. 22, 2023

(65) Prior Publication Data

US 2025/0052544 A1 Feb. 13, 2025

(30) Foreign Application Priority Data

Dec. 13, 2021 (NL) ..... 2030122

(51) Int. Cl.
*F41H 5/08* (2006.01)

(52) U.S. Cl.
CPC ..... *F41H 5/08* (2013.01)

(58) Field of Classification Search
CPC ..... F41H 5/08
(Continued)

(56) References Cited

U.S. PATENT DOCUMENTS 4,674,394 A 6/1987 Martino
11,650,025 B2 * 5/2023 Beck ..... A41D 1/04 89/36.01

(Continued)

FOREIGN PATENT DOCUMENTS

CN 2583608 Y 10/2003
CN 2859438 Y 1/2007

(Continued)

OTHER PUBLICATIONS

Stewart, J. "Ballistic Resistant Protective Materials", Sep. 1985, 16 pages, US United States National Institute of Justice Standard 0108.01.

(Continued)

*Primary Examiner* — Samir Abdosh
(74) *Attorney, Agent, or Firm* — Steven M. Koehler; Westman, Champlin & Kochler, P.A.

(57) ABSTRACT

A shield system comprises a protective shield body, a first accessory and a second accessory. The shield body comprises a shield panel provided with an edging, the shield panel having a first and second face defining a threat side in a threat direction and a protected side in a protected direction opposite the threat side and threat direction, respectively and having opposite panel edges, the edging covering at least part of the panel edges. The edging of the shield body comprises connectors operably connected with each other. The first and second accessories are operably connectable or connected with each other via the connectors for power and/or a signal transfer from the first accessory to the second accessory and/or back via the connectors.

19 Claims, 9 Drawing Sheets

(58) Field of Classification Search
USPC ..... 89/36.07
See application file for complete search history.

(56) References Cited

U.S. PATENT DOCUMENTS

| | | | | |
|---|---|---|---|---|
| 11,779,111 | B2 * | 10/2023 | Saenz | A47B 85/06 89/36.01 |
| 2007/0125224 | A1 | 6/2007 | Thomas | |
| 2007/0283477 | A1 | 12/2007 | Dovner | |
| 2007/0295199 | A1 | 12/2007 | Elasic | |
| 2010/0083820 | A1 | 4/2010 | Doyner et al. | |
| 2018/0017360 | A1 | 1/2018 | Adamow et al. | |
| 2019/0145741 | A1 | 5/2019 | Spransy et al. | |
| 2019/0390941 | A1 | 12/2019 | Beck | |
| 2023/0280136 | A1 * | 9/2023 | Beck | A41D 1/04 89/36.01 |

FOREIGN PATENT DOCUMENTS

| | | | |
|---|---|---|---|
| EP | 3587992 | A1 | 1/2020 |
| JP | 2005090930 | A | 4/2005 |
| WO | 2012027824 | A1 | 3/2012 |

OTHER PUBLICATIONS

International Search Report and Written Opinion for corresponding International application No. PCT/NL2021/050746 dated Mar. 10, 2022.

* cited by examiner

BALLISTIC SHIELD

CROSS-REFERENCE TO RELATED APPLICATION(S)

The present application is a § 371 national phase entry of International patent application Serial No. PCT/NL2022/050714, filed Dec. 12, 2022, and published in English, and claims priority from Netherlands application no. 2030122 filed on Dec. 13, 2021.

TECHNICAL FIELD

The present disclosure relates to protective shields, in particular to ballistic shields, more in particular to hand-held ballistic shields. In particular the present disclosure relates to a shield system comprising a shield body, a first accessory arranged on a threat side of the shield body and second accessory arranged on a protection side of the shield body opposite the threat side. The first and second accessories are, in use, connected for power and/or signal transfer.

BACKGROUND

Protective shields are known for millennia as useful defence devices to provide protection on a protected side (or: rear side) against force and/or impact from a threat side (or: front side). In modern days, shields are predominantly used by law enforcement and/or (para-) military units, e.g. as riot shields or ballistic shields. Ballistic shields have been developed for defence against bullets, similar projectiles and/or shrapnel. Typically, ballistic shields may be classified into distinct levels of protection.

As a result, different aspects of ballistic shields are known. Important considerations for (use of) ballistic shields may be conflicting and comprise, amongst others and not necessarily in this order: projectile impact resistance, weight, size, maneuverability, robustness (in general use, e.g. other than projectile impact resistance) and provision of subsystems and/or accessories like lamps, cameras, power supplies, offensive devices, etc.

Shields comprising accessories arranged on opposite sides of the shield body and being electrically connected are known. E.g. US 2010/0083820 discloses a ballistic shield with lighting and a power source. Light source(s) may be mounted to the front of the shield, a handle (including power source and one or more switches) may be mounted to the rear of the shield, and the light source(s) may be powered and controlled through conductive elements formed as part of the shield (either integrally formed or added, such as via one or more inserts (e.g., one or more threaded bolts, one or more rods, or the like)).

CN 2 583 608 Y discloses a police shield with an electric shock function, which is characterized in that the utility model is composed of a shield, an electric shock net and an electric storage device, wherein the electric shock net device is fixedly arranged on the front surface of the shield, while the electric storage device is fixedly arranged on the inner surface of the shield, the electricity storage device is electrically connected with the electric shock net which is arranged on the front surface of the shield, and furthermore, the electricity storage device is provided with a battery main switch and a touch switch. The electric shock net device and the electric storage device are connected by a wire penetrating through the shield.

These shields rely on transmitting electrical power through a hole in the shield, inherently compromising strength of the shield, which must be compensated in order to achieve sufficient protective value.

Another option is connecting the accessories by an electrical power cable simply led around an outer edge of the shield. However, such cable may tangle with and/or snag behind other objects.

It is noted that WO 2012/027824 discloses a system for inductive power transmission in a garment. A system for the inductive transmission of power from a primary coil to a secondary coil and its associated secondary circuits, and for the inductive transmission of data between the primary and secondary coils includes a hard body-armor plate mountable in a tactical garment wherein at least one primary coil is embedded in the plate behind the plate's strike-face by a substantially uniform said first depth, and wherein the primary circuits of the primary coil are adapted to be electrically connected to a central power source carried on or in cooperation with said garment, and at least one device pocket is provided for an electronic hand-held device wherein said device pocket is mountable to an outer surface of said garment so as to be in an inductively coupling position aligned over said primary coil in said plate to thereby align said secondary coil of a hand-held device in the device pocket over and into inductively coupled registry with said primary coil in the plate.

However, inductive power transmission is inherently lossy and the power loss rises dramatically with imperfect alignment between the primary and secondary coil, as a function of distance between the coils and in dependence any substance intervening between said coils. Moreover, inductive power transmission effectively is a transmission system which inherently emits electromagnetic signals which indicate presence of the system, potentially reducing or even destroying tactical advantage. The system is therefore considered unsuitable for a handheld ballistic shield in practice.

Further improvements in shields, in particular ballistic shields addressing the above are therefore always desired.

SUMMARY

In view of the above, herewith are provided at least a shield system, a shield body, and a use.

The shield system comprises a protective shield body, a first accessory and a second accessory. The shield body comprises a shield panel provided with an edging, the shield panel having a first and second face defining a threat side in a threat direction and a protected side in a protected direction opposite the threat side and threat direction, respectively and having opposite panel edges, the edging covering at least part of the panel edges. The shield body comprises connectors operably connected with each other, wherein the edging comprises at least one and preferably all of the connectors, The first and second accessories are operably connectable or connected with each other via the connectors for power and/or a signal transfer from the first accessory to the second accessory and/or back via the connectors.

The shield panel provides the protective shield function. The shield panel may be flat (planar) or at least partly bent in one or more directions, e.g. being concave or biconcave. An at least partly bent shape, which may be mono- or polygonal or at least partly smoothly curved, may provide protection in plural threat directions. The edges may provide any suitable perimeter shape, whether regular or irregular, to the shield panel to provide an accordingly shaped shield body.

A ballistic shield panel may be bullet proof for small calibre ammunition such as from handguns and/or rifles. The panel may be of a type as classified in any one of five types (IIA, II, IIIA, III, or IV, respectively) by level of ballistic performance under US United States National Institute of Justice Standard-0108.01, "Ballistic Resistant Protective Materials" (September 1985), or a comparable type.

The panel may have any suitable construction. For instance, the panel may comprise one or more layers of one or more of metal, glass, ceramic materials, polymeric material, such as polyacrylics, polyethylene, aramide, any of which possibly fixed together by one or more suitable adhesives and/or binders. The first and/or second face may be at least partly covered with a surface layer such as a paint and/or textile layer, for purposes of one or more of signalling, appearance, cleaning, weather resistance and wear resistances.

The edging covers at least part of the edges. The edging provides protection against damage of the shield panel edges. Such damage may comprise one or more of denting, chipping, delamination, and liquid damage in particular due to water and/or oils. In particular, the edging may be at least partly resilient. The edging may comprise, or be essentially of, one or more of natural rubber, a synthetic rubber, a polyurethane-material, a silicone-material, and combinations thereof.

Interconnecting the first and second accessories to each other via the connectors also allows direct, robust, operable connection between the accessories. The connectors may provide fixed positions on the shield body, this may simplify positioning connections and/or accessories on the shield body and/or it may prevent a loose cable section.

The edging comprising at least one of the connectors facilitates mounting the connector to the shield body without affecting ballistic properties of the shield panel.

The connectors and the first and second accessories may be configured for electrical power transfer from the first accessory to the second accessory and/or back via the connectors. Also or alternatively, the connectors and the first and second accessories may be configured for electrical and/or optical signal transfer from the first accessory to the second accessory and/or back via the connectors, which may comprise data signal and/or control signal transfer.

The first and second accessories may be arranged on the same side of the shield body. However, the first accessory may be arranged on the threat side and the second accessory may be arranged on the protected side. Then the connectors facilitate connection of the first and second accessories and obviate guiding a cable around the edging for connecting the accessories. In particular, at least one of the connectors may be arranged on or towards the threat side and at least one of the connectors may be arranged on or towards the protected side, which facilitates establishing the connection and/or allows reducing size of an accessory and/or any associated cable.

Having the first and second accessories on the opposite sides of the shield body allows safely transferring power and/or signals between the accessories, e.g. this allows control of the first accessory on the threat side from and/or by (the second accessory on) the protected side, and/or this allows presenting on one side by one accessory a signal indicative of another signal transferred from the other side by the other accessory.

The first and second accessories may comprise at least one of: a light source; a loudspeaker; a visual indicator, such as indicia, light banner, display, etc.; a sensor, such as a camera (e.g. visible and/or infrared-sensitive), a microphone, a substance detector like a gas detector; a recording device for one or more sensor signals and/or written information; and a power source such as a battery, possibly rechargeable.

The connectors may be at least partly accommodated in the edging. This provides protection to at least part of one or more of the connectors, the shield panel, the edging, an accessory connected to one or more of the connectors, and a user of the shield body. E.g., by the accommodation, protrusion of the connector from the shield body may be reduced or prevented at least in part. Also or alternatively, the edging may assist fixing the connectors to the shield panel.

Likewise, also or alternatively, power and/or signal conductors operably connected with the connectors may be at least partly accommodated in the edging.

The connectors may preferably provide a connection direction for connection with a mated counterconnector substantially perpendicular to the first and/or second face of the shield panel at least at the location of the respective connector. This facilitates connection of a connector with a suitable counterconnector. Also or alternatively, the connectors may preferably not extend from the panel beyond the edging and/or may preferably not extend from the panel beyond a perimeter of the shield body defined by the edging. This may reduce or prevent the connectors—and any object connected with it such as a cable—getting caught behind a further object. In particular, a connector may be recessed into the edging and a mated counterconnector may be formed so that, when connected, the connector and mated counterconnector together do not extend from the edging and/or do not extend beyond a perimeter of the shield body defined by the edging.

In the shield body, a plurality of the connectors, preferably all connectors, may be substantially identical. This may facilitate one or more of design and manufacture of the shield body, inventory and freedom of placement of accessories and/or counterconnectors.

A plurality of the connectors may be arranged in groups of connectors separated by relatively small distances, the groups of connectors being separated by relatively large distances. This may facilitate providing particular arrangements of accessories. Further, an accessory may be connected to plural connectors or groups of connectors for increased robustness.

A plurality of the connectors may be attached to each other as an object attached to the panel and to the edging, e.g. being integrated in such object. In particular, a plurality of the connectors may be formed as, or be connected by, a strip or a rail along at least part of the edging. E.g., at least part of at least some of the connectors may be formed as, and/or formed along, and/or comprised in, a rail. This may increase flexibility of placement of an accessory.

At least some of the connectors may be fixed onto the panel prior to providing the edging. This may facilitate manufacturing of the shield body and/or increase robustness of the shield body. The fixation may comprise clamping onto the panel. Also or alternatively gluing and/or welding etc. may be used.

At least some of the connectors may be releasably attached onto the panel. This may facilitate exchange and/or repair, in particular in case the edging is releasably attached to the panel.

A plurality of the connectors on and/or towards the threat side and connectors on and/or towards the protected side may be in register with each other in a direction normal to the first face and/or the second face of the panel. This may facilitate connecting accessories aligned to each other and/or providing balance to the shield.

The operable connection between the connectors may be provided by at least one cable, which cable may extend along an edge of the panel for transferring power and/or a signal such as a sensor signal and/or a control signal. The cable may be at least partly accommodated in the edging and/or in one of the connectors. This may reduce or prevent the cable from getting caught behind another object, which may cause damage and/or may even cause a danger to a user of a shield comprising the shield body. Note that such a cable may also be provided as (part of) an accessory in a shield system comprising a shield body as described herein. Such accessory cable may then be suitably connected via one or more of the connectors with at least part of the aforementioned cable comprised in the shield body. Such cable may comprise one or more electrical and/or optical signal conductors for operable connection to an associated electrical and/or optical connector.

At least part of the edging may be overmoulded onto at least part of the connectors and possibly on at least part of conductors connecting the connectors, where applicable. The connectors may be at least partly accommodated in and fixed by the overmoulded portion of the edging, and/or wherein, if present, the cable and/or the conduit, respectively, may be at least partly accommodated in and fixed by the overmoulded portion of the edging. Overmoulding provides a close adherence of the overmoulding material to the shield panel and the connector and possibly at least part of conductors (which may be comprised in a cable as set out elsewhere herein) and it may provide fixation of these parts to each other, providing robustness. The adherence to at least part of the shield panel and the connector may be mechanical and/or chemical in nature.

Although one or more cables may be provided for connecting the first and/or second accessory to associated connectors, the first accessory and/or the second accessory may comprise an connector mated to an connector of the shield body. In particular, the first accessory and/or the second accessory may comprise such connector fixed to the accessory, e.g. fixed to and/or integrated in a housing of the accessory. This obviates an intervening cable, reducing a number of parts and possibly a number of connections.

The connection between the first and second accessories via the connectors may be configured for optical signal transfer, for electrical signal transfer and/or for electrical power transfer between the two accessories.

At least some of the connectors and at least some conductors operably connecting at least some of the connectors may be configured for both power and data transmission. E.g., the connectors may comprise plural terminals connected to plural conductors; terminals and conductors for power conduction may be formed more robust than signal terminals and signal conductors. Signal terminals and/or conductors may be configured for transferring signals according to different (tele-) communication standards.

Transmission via conductors improves reliability compared to wireless transmission; transmission via conductors reduces or prevents interception of signals from outside and reduces latency of data transmission, improving signal quality and reliability. Therefore, performance may be improved. In particular in case of electrical power and/or signal transfer, electromagnetic signature may be reduced.

An embodiment may comprise electromagnetic shielding of at least part of the connectors and/or one or more conductors operably connecting the connecting the connectors. The electromagnetic shielding may reduce or prevent emission and/or reception of signals that may provide noise onto other electromagnetic signals and/or devices, possibly (further) reducing electromagnetic signature and/or improving stealthy use of the shield system. Also or alternatively signals transferred between the first and second accessories may be protected from picking up signals from different parts of the shield body and/or external to the shield system.

In the shield body, the shield panel may comprise one or more signal and/or power conductors operably connected with the connectors, in particular one or more electrical signal and/or power conductors. E.g. at least one electrical power and/or signal conductor may be formed as an at least partly electrically conductive layer operably connected with at least some of the electrical connectors.

The conductors may be at least partly integrated into the panel. This may provide flexibility and robustness, in particular in case the respective conductors are arranged towards the protected side.

In such an embodiment, the one or more power and/or signal conductors of the shield panel may be formed as an at least partly electrically conductive layer operably connected with at least some of the connectors being electrical connectors, for electrical power and/or signal transfer through the electrically conductive layer. This may prevent uneven surface structures of/on the shield panel, and thus the shield body, which may facilitate mounting an accessory onto the shield panel. Then, the shield panel may comprise a composite panel comprising a compressed stacked laminate of layers comprising the at least partly conductive layer. Thus, the at least partly conductive layer is an integral whole of the shield panel.

The shield panel may comprise a composite panel comprising a compressed stacked laminate of layers, wherein at least one of the layers comprises the one or more power and/or signal conductors, e.g. the at least partly electrically conductive layer. Thus, a robust connection may be formed.

In an embodiment, the shield body comprises one or more mounts for mounting at least one of the first and second accessories onto the shield body. The mounts may provide for movable mounting and/or for fixation of the accessory. The mounting may be removable, e.g. comprising one or more of bolting, bayonet fastening, snap latching, etc.

At least part of a mount may be accommodated in the edging, possibly by overmoulding. This may reduce volume of the shield body and possibly also of the shield body and an accessory mounted to the mount. E.g., by the accommodation, protrusion of the mount from the shield body may be reduced or prevented at least in part. Also or alternatively, the edging may assist fixing the mount to the shield panel.

One or more of the connectors and one or more of the mounts may be integrated for mounting and connecting at least one of the first and second accessories onto the shield body. This may simplify mounting and connecting an accessory to the shield body. In particular, at least part of a connector and at least part of a mount may be electrically conductive.

In the shield system, the shield body may be provided with one or more expansion brackets as an accessory, which may serve for supporting one or more other accessories Such expansion bracket may be mounted to one or more mounts of the shield body. Such expansion bracket may comprise further connectors and one or more further power and/or signal conductors operably connected or connectable with one or more connectors of the shield body.

E.g., in an embodiment wherein the shield body is provided with one or more such expansion brackets, one or more accessories may be mounted to at least one of the expansion brackets provided on the shield body, at least part of the expansion bracket being electrically conductive and the expansion bracket comprising electrical connectors operably electrically connectable or connected with at least one of the electrical connectors of the shield body and with the at least one of the first and second accessories, so that the first and second accessories are operably electrically connectable or connected via the electrical connectors of the shield body and of the expansion bracket. This facilitates connecting accessories to the shield body. Also or alternatively, an expansion bracket may comprise optical conductors and one or more accessories may be operably connected with one or more optical connectors of the shield body via the expansion bracket.

In view of the above, and providing at least some of the benefits discussed above in respect of the shield system, in an aspect use of a shield body for operably connecting a first accessory and a second accessory for transferring signals (e.g. data) and/or power between the first and second accessories is provided.

Then, the shield body comprises a shield panel provided with an edging, the shield panel having a first and second face defining a threat side in a threat direction and a protected side in a protected direction opposite the threat side and threat direction, respectively, and having opposite panel edges, the edging covering at least part of the panel edges. The edging of the shield body comprises one or more connectors for power and/or signal transfer from the first accessory to the second accessory and/or back via the connectors transferring the signals and/or power, e.g. electrical and/or optical connectors for transmitting the data and/or power between the first and second accessories, and the use comprises operably connecting the first and second accessories, and transferring the signals from the first accessory to the second accessory and/or back via the connectors.

The first accessory may be arranged on the threat side and the second accessory may be arranged on the protected side of the shield body.

In view of the above, and providing at least some of the benefits discussed above in respect of the shield system and the use, in another aspect a shield body is provided for a shield system disclosed herein and/or for the use disclosed herein, wherein the shield body comprises a shield panel provided with an edging, the shield panel having a first and second face defining a threat side in a threat direction and a protected side in a protected direction opposite the threat side and threat direction, respectively and having opposite panel edges, the edging covering at least part of the panel edges. The edging of the shield body comprises one or more connectors for power and/or signal transfer. The shield panel further comprises one or more power and/or signal conductors operably connected with the connectors for power and/or signal transfer via the connectors. Then, the one or more power and/or signal conductors may be formed as an at least partly electrically conductive layer operably connected with at least some of the connectors being electrical connectors.

E.g. the panel is provided with an at least partly conductive layer operably connected with at least some of the electrical connectors for data and/or power transmission between the connectors through the at least partly conductive layer.

The shield panel may comprise a composite panel comprising a compressed stacked laminate of layers wherein at least one of the layers comprises the one or more power and/or signal conductors, e.g. the at least partly electrically conductive layer. Thus, the shield panel may comprise a composite panel comprising a compressed stacked laminate of layers, wherein the laminate comprises the aforementioned at least partly conductive layer operably connected with at least some of the connectors being electrical connectors.

BRIEF DESCRIPTION OF THE DRAWINGS

The above-described aspects will hereafter be more explained with further details and benefits with reference to the drawings showing a number of embodiments by way of example.

DETAILED DESCRIPTION OF EMBODIMENTS

Figure 2B:
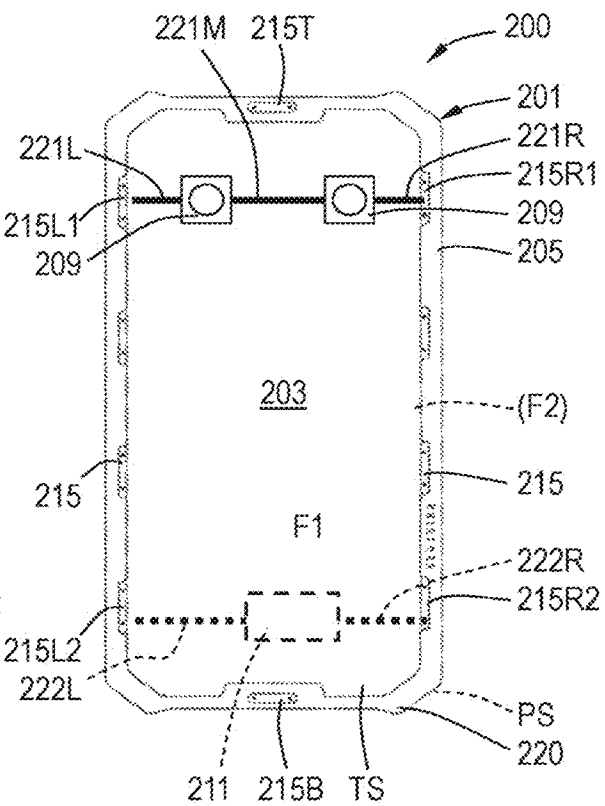
FIGS. 2A-2B indicate an improved shield system.

It is noted that the drawings are schematic, not necessarily to scale and that details that are not required for understanding the present invention may have been omitted. The terms "upward", "downward", "below", "above", and the like relate to the embodiments as oriented in the drawings, unless otherwise specified. Further, elements that are at least substantially identical or that perform an at least substantially identical function are denoted by the same numeral, where helpful individualised with alphabetic suffixes.

Further, unless otherwise specified, terms like "detachable" and "removably connected" are intended to mean that respective parts may be disconnected essentially without damage or destruction of either part, e.g. excluding structures in which the parts are integral (e.g. welded or moulded as one piece), but including structures in which parts are attached by or as mated connectors, fasteners, releasable self-fastening features, etc. The verb "to facilitate" is intended to mean "to make easier and/or less complicated", rather than "to enable".

Figure 1:
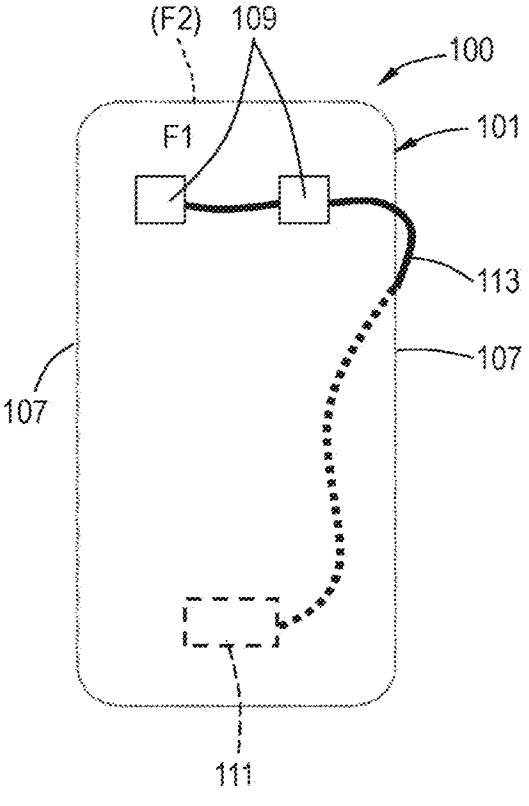
FIG. 1 indicates a known shield system.

FIG. 1 indicates a known shield system 100. The shield system 100 comprises a protective shield body 101. The shield body 101 has a first face F1 (facing the viewer in FIG. 1) and second face F2 (invisible) defining a threat side in a threat direction (towards viewer) and a protected side in a protected direction opposite the threat side and threat direction, respectively, and has opposite panel edges 107. The shield body 101 is provided with first accessories 109 such as lamps on the threat side and second accessories 111 such as a battery on the protected side. The first and second accessories 109, 111 are operably electrically connected via a cable 113 led around the edge 107 of the shield body 101. The cable 113 comprises at least two conductors providing a closable current circuit for transferring power from the battery to the lamps so that the lamps 109 may be operated.

Figure 2A:
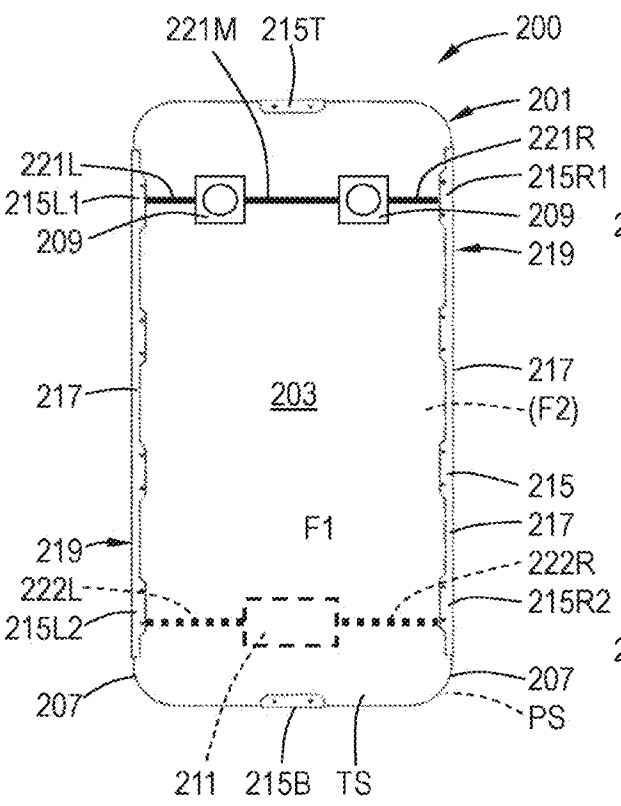

FIGS. 2A, 2B indicate an improved shield system 200 comprising a protective shield body 201. The shield body 201 comprises a shield panel 203 provided with an edging 205 (only shown in FIG. 2B). The shield panel 203 has a first face F1 (facing the viewer) and second face F2 (invisible) defining a threat side TS in a threat direction (towards viewer) and a protected side PS in a protected direction opposite the threat side and threat direction, respectively, and having opposite panel edges 207. The edging 205 covers the panel edges 207.

Best seen in FIG. 2B is that the edging 205 of the shield body 201 comprises electrical connectors 215. In FIG. 2A, showing the shield body with the edging 205 removed, is visible that the electrical connectors 215 are operably electrically connected with each other by electrical conductors 217. Although other conductors like cables could be provided, in this embodiment, the electrical connectors 215 and electrical conductors 217 are provided as integral conductive elements 219, 219, e.g. aluminium and/or steel profiles, extending along the edges 207 of the shield panel 203. The connectors 215 (and possibly at least part of the conductors 217) are optionally formed as U-shaped portions fitting about the edge 207 of the panel 203 and extending on either side (threat side, protected side) of the shield body 201 and being contactable on either side.

The shield body 201 is provided with lamps 209 as exemplary first accessories on the threat side TS and a battery 211 as exemplary second accessory on the protected side PS. The lamps 209 are operably electrically connected via a conductor 221L with a connector 215L1 on the threat side TS and on one lateral side L of the shield body 201, and via a conductor 221L with a connector 215R1 on the threat side TS and on the other lateral side R of the shield body 201. The lamps 209 are operably electrically connected with each other via a further conductor 221M. One pole of the battery 211 is connected via a conductor 222L with a connector 215L2 on the protected side and on one lateral side L of the shield body 201 and the other pole of the battery 211 is connected via a conductor 222R with a connector 215R2 on the protected side and on the other lateral side R of the shield body 201. Thus, a closed current circuit is provided between the battery 211 and the lamps 209 via the connectors 215L2, 215L1, 217R1 and 217R2 and the associated conductors 222L, 217L, 221L, 221M, 221R, 217R, 222R, wherein the lamps are arranged on the threat side TS and the battery is arranged on the protected side PS without requiring a cable led around the edge of the shield body 201. An optional switch for controlled opening and closing the current circuit may be provided but is not shown.

FIG. 2B shows that the conductive elements 219 (shown in FIG. 2A as discussed before), are accommodated in the edging 205 which provides structural protection and electrical insulation of the conductive elements 219L, 219R and thus of the conductors 217 and (part of) the connectors 215.

The lamps 209 and the battery 211 may be attached to the shield body 201 in any suitable manner, e.g. using glue, welding, hook-and-loop-type fabric fasteners such as Velcro®, clamping, etc.

In the embodiment of FIGS. 2A, 2B the connectors 215 are basic conductive metallic structures and an electrical connection may be established by bolting a conductive structure such as a cable, possibly provided with a cable shoe, to the connector 215. However, the connectors 215 in this embodiment may also be used as mounts for mounting one or more of the respective accessories 209, 211 onto the shield body; for this, one or more the conductors 221L, 221M, 221R; 222L, 222R, may be formed as constructive elements for mounting and supporting the respective accessories 209, 211, e.g. metallic strips, providing both mechanical support and electrical conductivity. However, the mechanical and electrical aspects may be separated, e.g. by providing the electrical conductivity via one or more (possibly insulated) cables and mounting the accessories via other structures which may be not electrically conductively connected to other structures.

Note that the shield body 201 has optional further structures 215T and 215B accommodated in the edging 205 optionally of the same construction as the connectors 215L, 215R, which may serve as mechanical mounts for mounting one or more accessories and/or as electrical connectors for transferring power and or signals between the threat and protected sides if not electrically connected with one or more other electrical connectors.

Providing the edging 205 by overmoulding over the shield panel 203 and the conductive elements 219 provides fixation, or assists fixation, of the elements 219, 215T, 215B onto the panel 203. Also or alternatively, the edging 205 may provide bulk around at least part of a connector 215, which may provide mechanical support and/or protection for a structure connected with the respective electrical connector 215, and/or a structure mounted to the connector when the respective connector 215 serves as a mechanical mount instead of, or in addition to, serving for electrical connection.

Note that in any embodiment herein plural connectors may be connected to a conductor, in particular an electrical connector. This may facilitate connecting plural accessories electrically in parallel and/or in series. E.g., in the embodiment of FIGS. 2A-2B the lamps and/or battery and any further accessory (not shown) may be (also) operably connected to another connector 215. Also or alternatively, this may facilitate interconnecting plural accessories for signal transfer between different ones of the plural accessories in network fashion.

An electromagnetic shielding construction, e.g. a conductive mesh and/or an at least partly closed cover, may be provided and then may be at least partly accommodated in the edging, possibly fixed in position by provision of the edging by overmoulding.

Figure 3B:
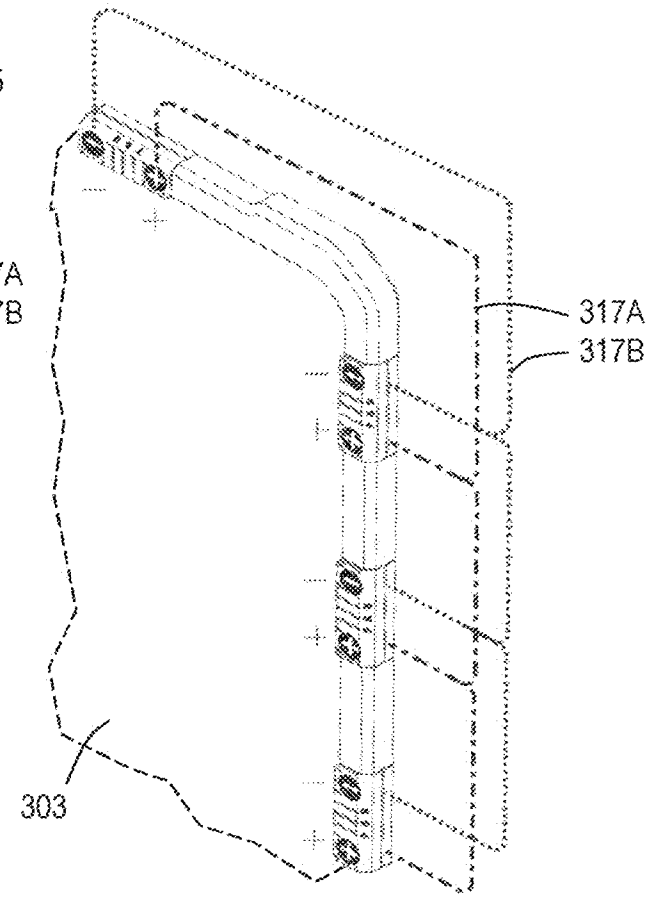
FIGS. 3A-3B show (part of) a shield body of a further embodiment.
Figure 3A:
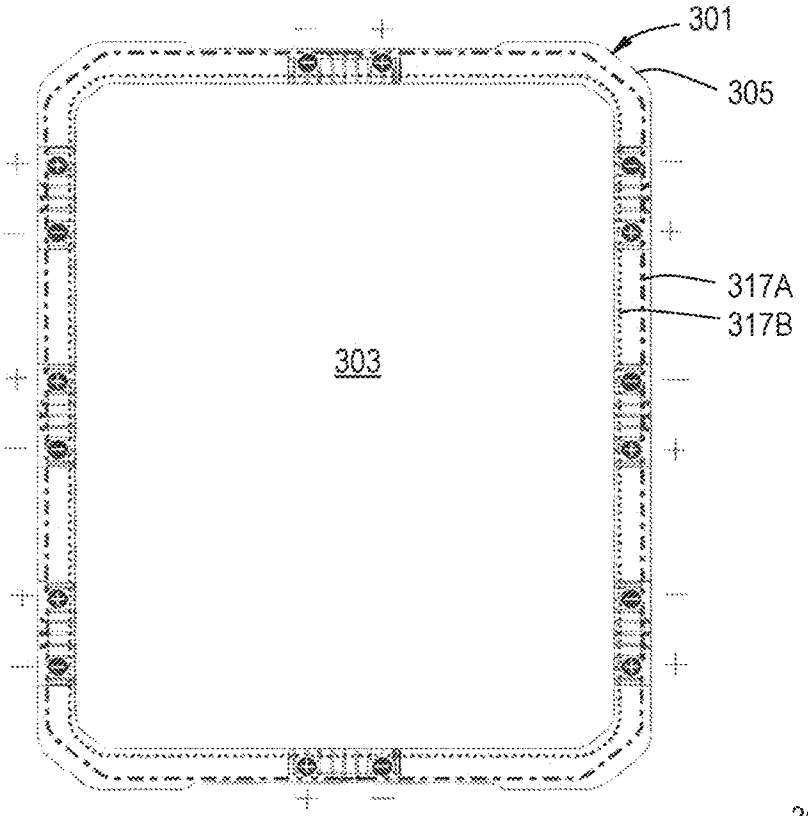

FIGS. 3A, 3B show (part of) a shield body 301 as a further developed embodiment. The shield body 301 comprises a shield panel 303 and an edging 305. Here, as indicated schematically, two conductors 317A, 317B are accommodated in the edging 317, each connected with a respective terminal of a connector 315 (denoted + and − respectively, although any embodiment herein may support alternating current (AC) and/or direct current (DC) as desired). The shield 303 facilitates establishing a closed current loop between adjacent connectors 315 of the shield body 301. Instead of having the conductors 317A, 317B connecting all connectors 315, only some of the connectors may be connected and/or one or more of the conductors 317A, 317B may be interrupted in one or more positions instead of forming a closed loop. Also or alternatively, arrangement of poles may be different, e.g. the shield body 301 defining a particular orientation and the poles being arranged the same with respect to that orientation (e.g. all + poles being arranged above the − poles).

In any embodiment, the connectors may be clamping connectors onto which a counter connector may be clamped for establishing an electrical connection. However, use of mated connector-counterconnector combinations is preferred for facilitating connection easily and reliably. E.g. the shield body may be provided with a receptacle connector and the accessory and/or a cable may be provided with a mated plug connector or the other way around, or hermaphroditic connectors may be used. Any connector herein may be proprietary or adhere to a suitable standard.

Figure 4B:
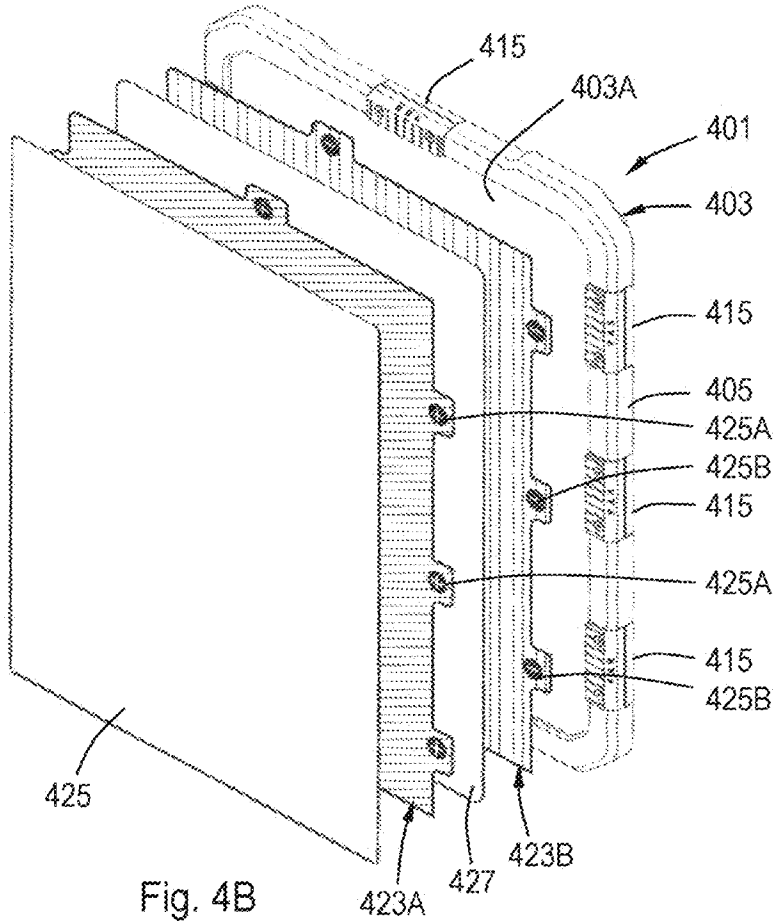
FIGS. 4A-4B; 5A-5B indicate in plan view and partly exploded view a shield body of further embodiments.
Figure 4A:
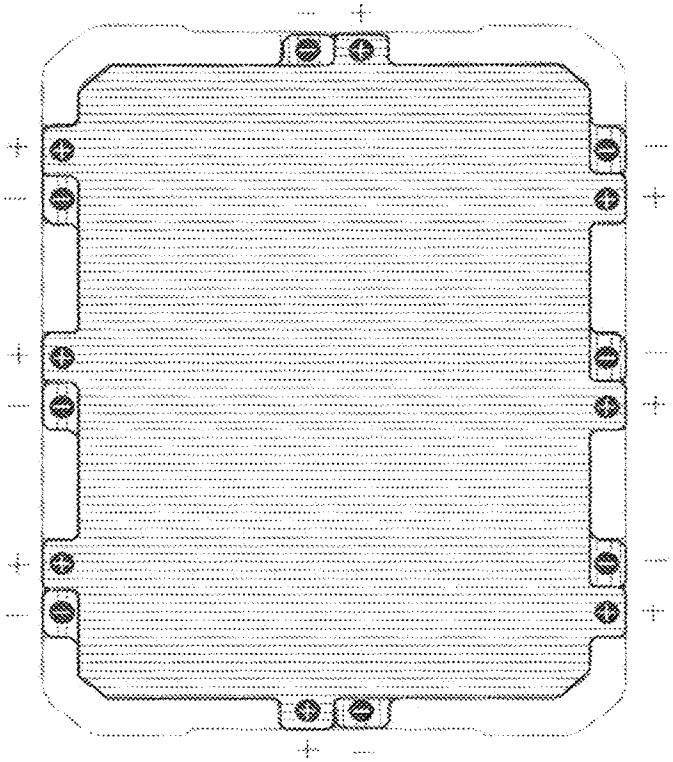

FIGS. 4A 4B show schematically in plan view and partly exploded view a shield body 401 comprising a shield panel 403 which is provided with conductive layers 423A, 423B operably connected with at least some of the electrical connectors 415. The conductive layers 423A, 423B are insulated from each other and from external structures by insulating layers 425, 427. The conductive layers 423A, 423B may be adhered to a ballistic panel which typically is electrically insulating. The panel may comprise or be a composite panel comprising a compressed stacked laminate of layers, e.g. of aramide.

The conductive layers 423A, 423B may be adhered to a ballistic panel to provide the shield panel 403 onto which the edging 405 is applied, or the conductive layers 423A, 423B may be adhered to a partly finished shield body comprising the shield panel 403 and the edging 405 to provide the desired shield body 401. The conductive layers 423A, 423B may be covered at least in part by the edging 405. The conductive layers 423A, 423B are provided with portions 425A, 425B for connecting at least some of the connectors 415 of the shield body 401. The connections may be soldered, welded, clamped and/or suitably connected otherwise with the connectors 415.

Note that also or alternatively, one or more conductive layers and preferably one or more insulating layers insulating such conductive layer(s) may be integrated into the panel 403 as part of the compressed stacked laminate.

Figure 5B:
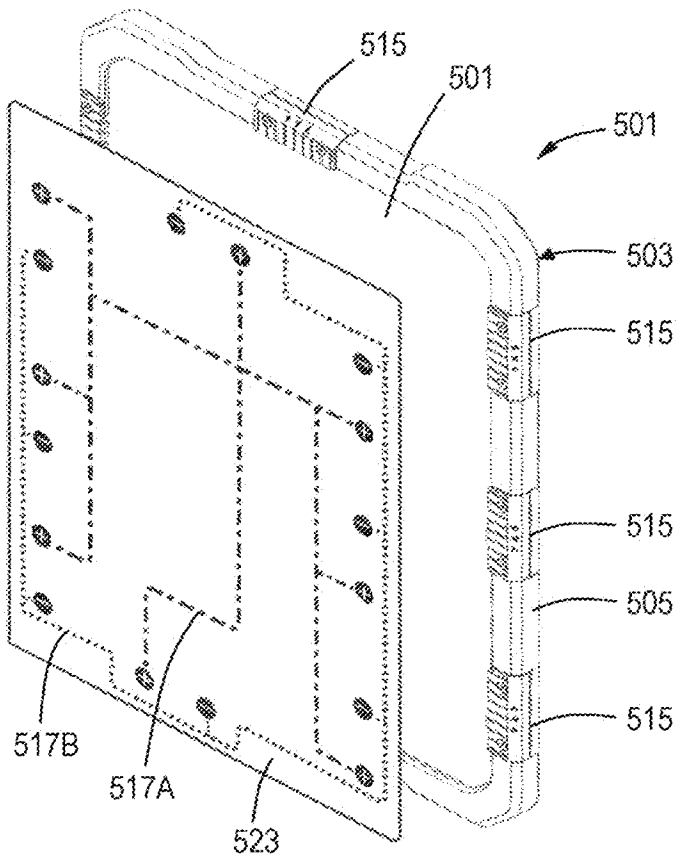
Figure 5A:
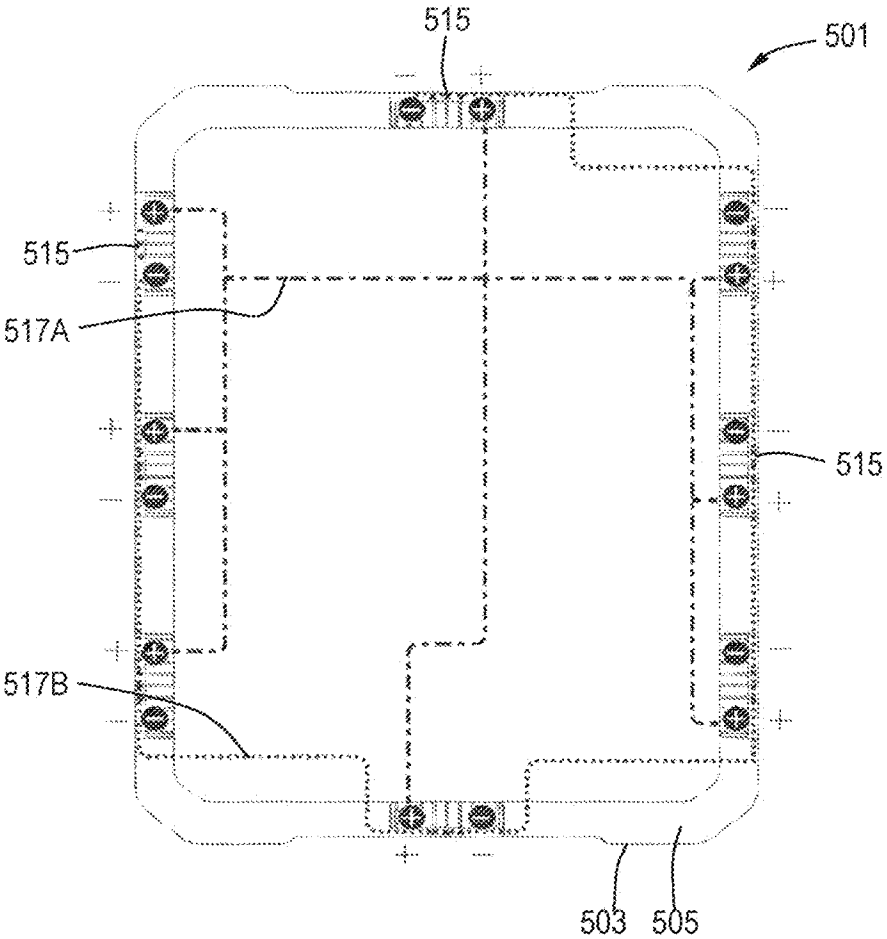

FIGS. 5A-5B show, like FIGS. 4A-4B, a shield body 501 comprising a shield panel 503 which is provided with a conductive layer 523 operably connected with at least some of the electrical connectors 515. The layer 523 comprises a plurality of conductors 517A, 517B, preferably formed as conductive traces 517 for each connecting terminal of at least some of the connectors 515, although one or more of the conductors of the layer may be provided as one or more wires adhered to and/or embedded in the layer 523, e.g. woven in a fabric layer. Thus, particular desired electrical circuits may be provided for connecting predetermined ones of the connectors 515 with each other (in FIGS. 5A-5B all connectors 515 are connected).

Note that a shield body may comprise one or more optical connectors and one or more optical conductors such as optical fibers, operably connected to the optical connectors. The optical conductors may be accommodated in the edging by overmoulding; an opaque portion of the edging may provide optical insulation.

Figure 6B:
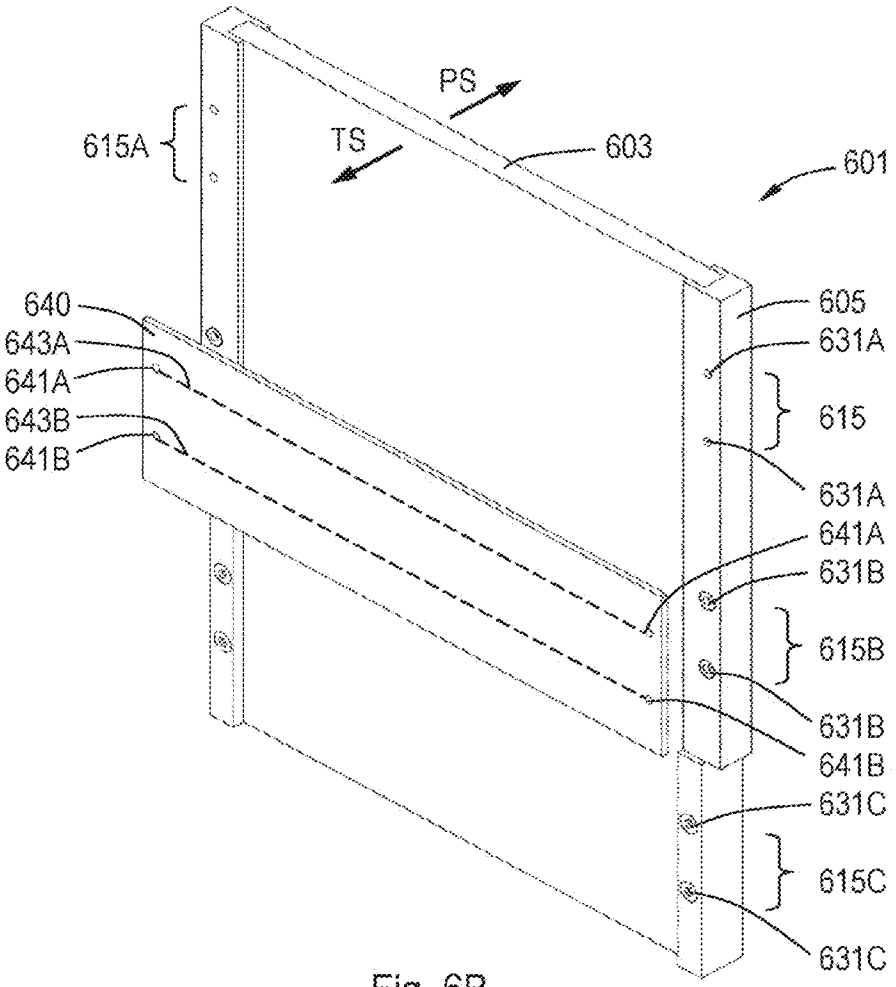
FIG. 6A-6B indicate parts of a shield body of a further embodiment.
Figure 6A:
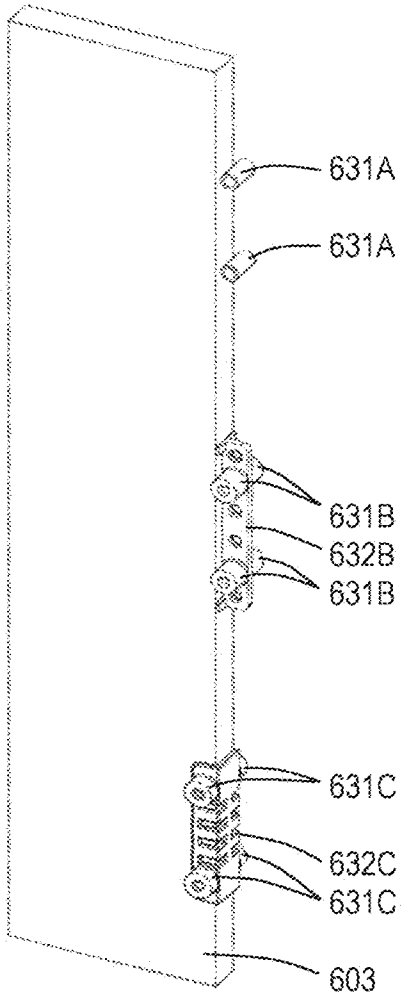

FIGS. 6A and 6B schematically show a shield body 601 according to the present concepts and, respectively, a shield panel 603 and different embodiments of parts of connectors 615A, 615B, 615C of the shield body 601. The shield body 601 further is provided with an expansion bracket 640 (schematically shown), see below.

Connector 615A comprises terminals 631A, provided as conductive receptacle terminals for connection with plug terminals of a mated connector (not shown). In some embodiments, receptacle terminals and/or plug terminals may be provided with threaded portions and/or other mechanical attachment structures. The connector 615A for plural conductors, e.g. + and − poles or power and ground poles, may be provided by suitably connecting conductors to the terminals 631A and fixing the terminals 631A (and possibly at least part of the conductors) in the edging 605. The terminals 631A may be connected by (terminals of) a suitable counterconnector from the threat side TS and protected side PS for operably electrically connecting accessories on opposite sides of the shield body 601.

Connector 615B comprises conductive terminals 631B supported on an insulating support 632B. At least some terminals 631B on opposite sides of the support 632B may be electrically connected e.g. being a single object (cf. terminals 631A). Also or alternatively, some terminals may be insulated from each other. The shown support 632 may be provided with additional terminals, not shown. Note that in general herein, different terminals of one or more connectors may have different shape and/or construction, e.g. in accordance with different requirements for transferring power and/or signals.

Connector 615C comprises conductive terminals 631C supported on an insulating support 632C arranged for placing the terminals overlapping the shield panel 603. Such connector may be particularly suitable for use with a shield panel comprising one or more at least partly conductive layers, wherein the terminals 631C are connected with suitable conductive portions of such conductive layer (cf. FIGS. 4A-5B).

Accommodating (the terminals of) the connectors in the edging may expose more or less of (the terminals of) the connector.

The expansion bracket 640 may comprise one or more connectors 641A, 641B and one or more conductors 643A, 643B for electrical connection to respective ones of connectors of the shield body 601, e.g. comprising terminals mated to the terminals of the respective connectors 615A/615B/615C.

The expansion bracket 640 may be mounted onto the shield body 601. Accessories (not shown) may then be mounted onto the expansion bracket 640 and electrically connected with connectors of the shield body 601 and/or with conductors of the expansion bracket 640. For that, the expansion bracket may comprise (further) electrical connectors (not shown).

Figure 7B:
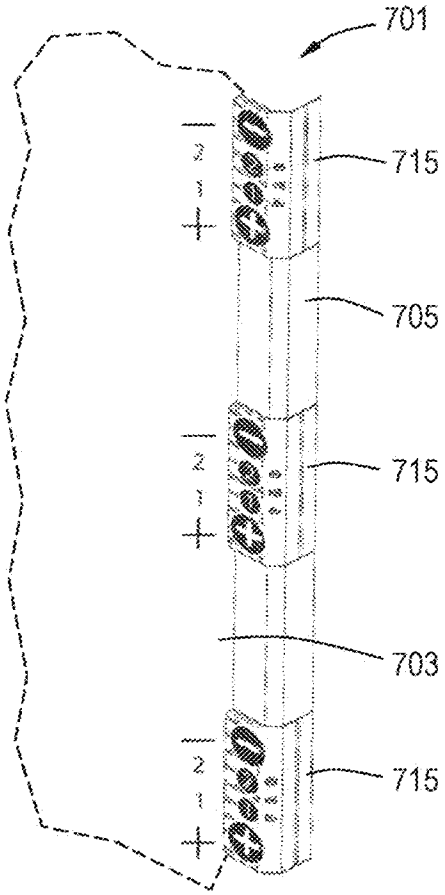
FIGS. 7A-7B shows a shield body of further embodiment and a detail thereof.
Figure 7A:
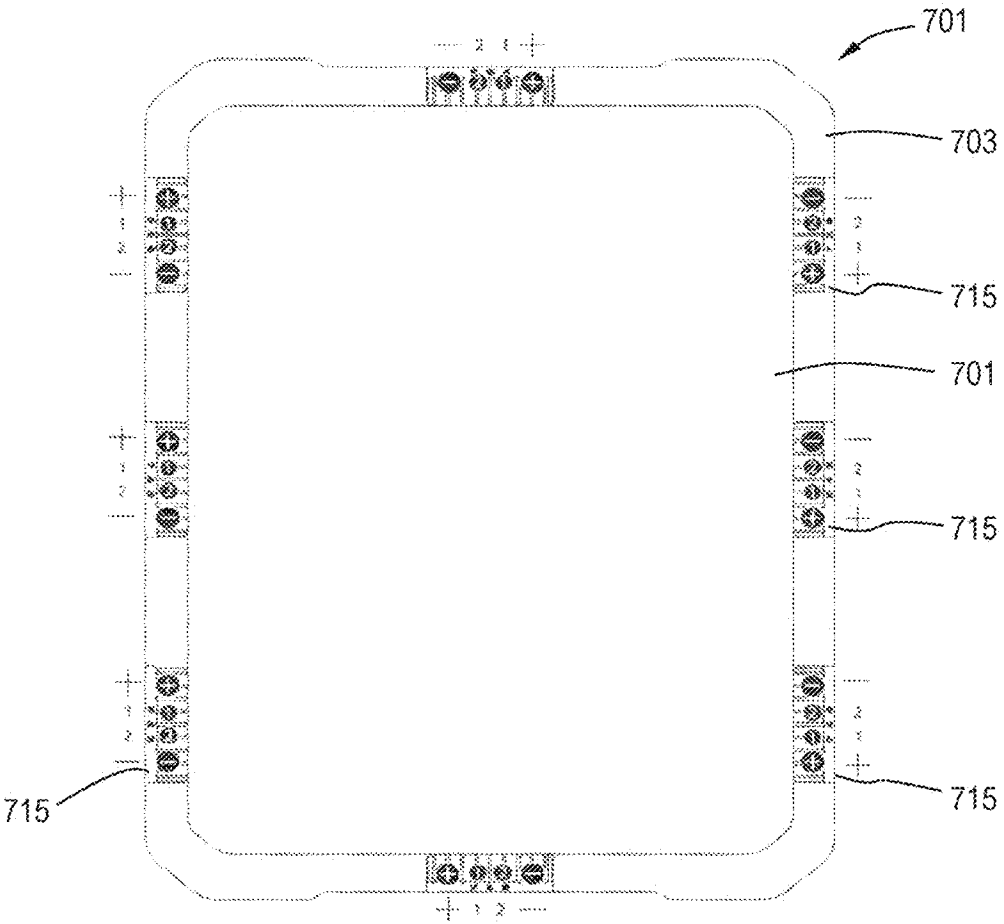

FIG. 7A, and detail FIG. 7B indicate in plan view and perspective view, respectively, that a shield body 701 may comprise connectors 715 for connecting plural conductors (not shown), for transferring power (indicated with + and −) and data (indicated with 1 and 2). E.g., part of the connectors may be configured according to USB-standards and/or other standards with regard to a connector configuration and/or (suitability for) a data transmission protocol. Note that other configurations requiring more or less conductors may be provided; in some cases data may be transmitted by superposing a data signal on a power connection, so that only two conductors may suffice.

Figure 8B:
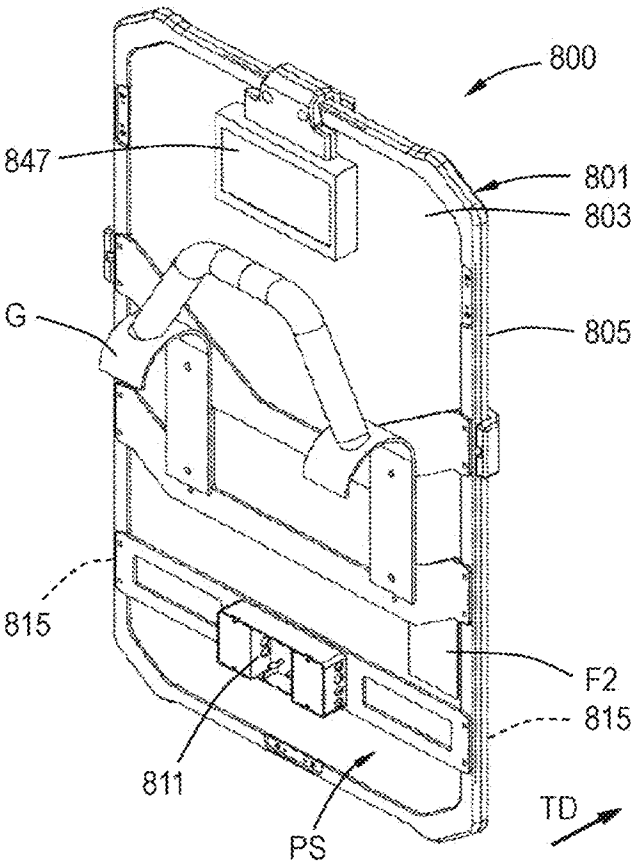
FIGS. 8A-8B show an embodiment of a shield system.
Figure 8A:
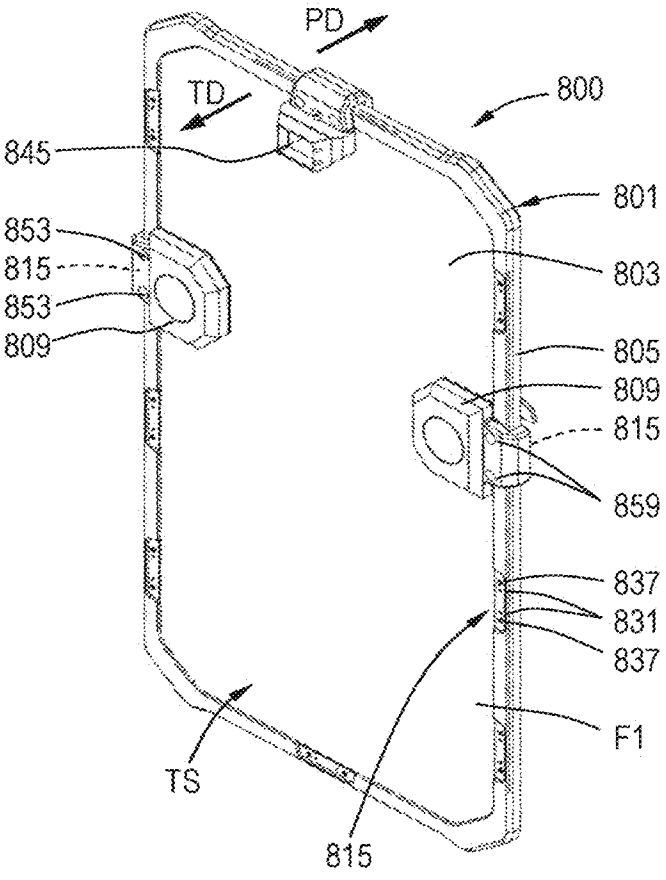

FIGS. 8A-8B show a shield system 800 comprising a shield body 801 provided with plural accessories: lamps 809 and a camera 845 arranged on the threat side TS of the shield 801; a battery 811 and a display and control unit 847 associated with the camera 845 on the protected side PS of the shield 801. On the protected side the shield body 801 is provided with a carrying support G, mounted to mechanical mounts on the shield body 801.

The shield body 801 comprises electrical connectors 815 comprising terminals 831 integrated with mechanical mounts 837, e.g. threaded holes for bolting. The shield body 801 comprises, embedded in the edging 805, plural conductors (not shown) operably electrically connecting associated electrical terminals 831 of the connectors 815.

In this embodiment, the lamps 809 are optionally configured as complementary structures to the shield body, in particular to the edging 805, and comprising electrical connectors (not shown) mated to the electrical connectors 815 and mechanically mountable to the mounts 837, e.g. using bolts 853, fixing the lamps to the shield body 801.

The battery 811 is mounted onto an expansion bracket 840, comprising conductors (not shown). Via the conductors of the expansion bracket 840 and of the shield body 810 and via the respective electrical connectors 815, the lamps 809 may be operably powered.

The camera 845 and the display and control unit 847 are, largely similar to the lamps 809, optionally formed complementary to part of the shield body 801 facilitating mechanical mounting thereof to the shield body 801. Each of the camera 845 and the display and control unit 847 comprises an electrical counterconnector mated to an electrical connector comprised in the shield body 801 which here are arranged (in register) on opposite sides of the shield body. Thus signals may be transferred between the camera 845 and the display and control unit 847 for safely operating the camera 845 and/or displaying images recorded by the camera 845.

Note that by appropriate placement of accessories on the shield body, with or without expansion brackets, may allow for balancing of the shield. Selecting a suitable arrangement of accessories may be facilitated by providing plural connectors that are operably interconnected. E.g. in FIGS. 2A-2B and 8A-8B the battery may be positioned as a counterweight to lamps and/or further accessories.

Figure 9B:
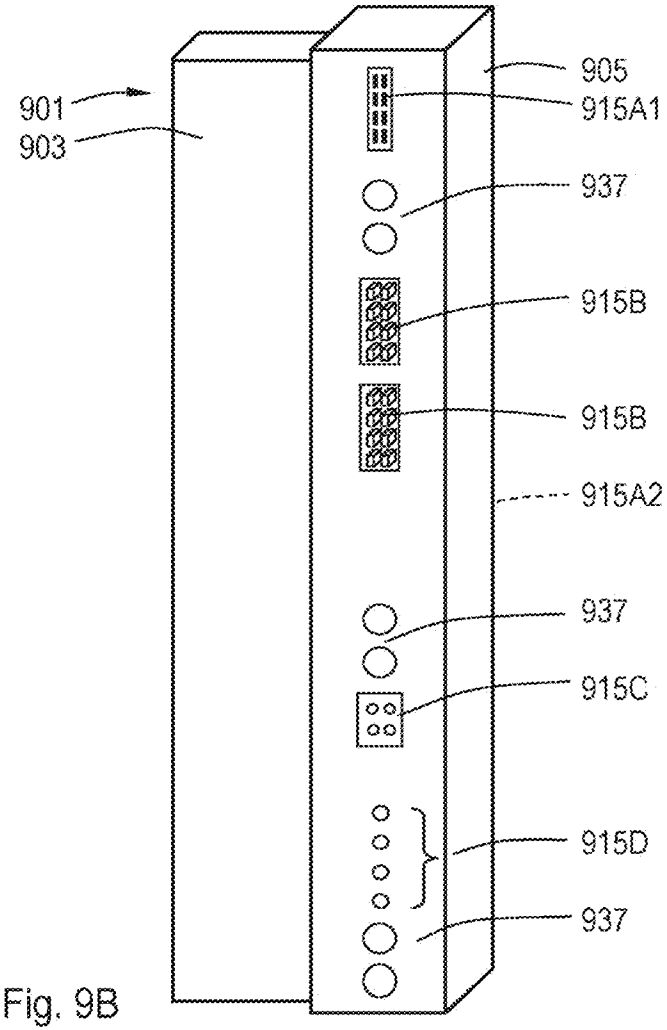
FIGS. 9A-9B indicate parts of a shield body of a still further embodiment.
Figure 9A:
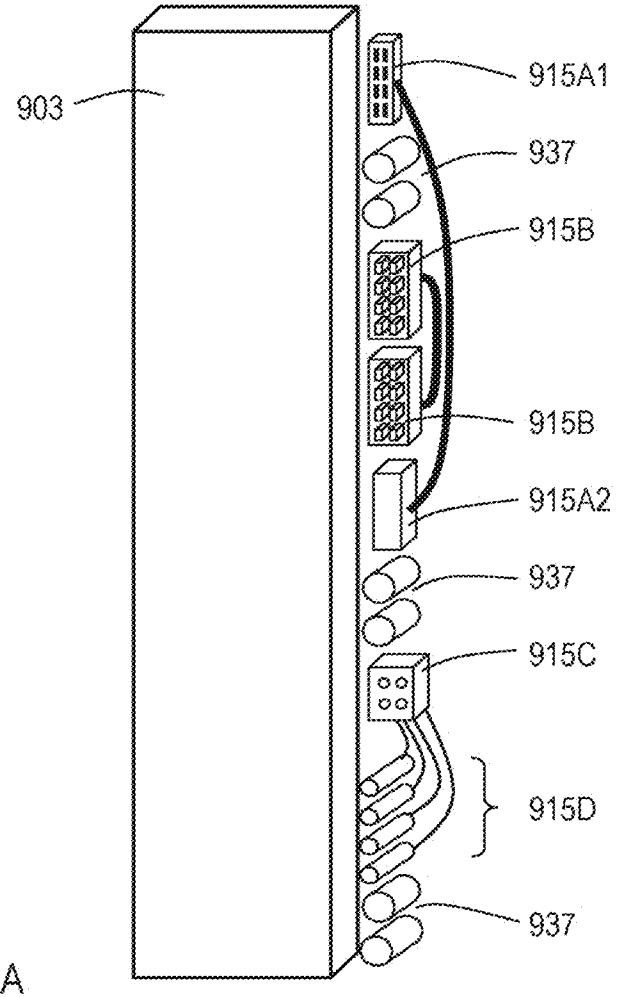

FIGS. 9A-9B indicate, like FIGS. 6A-6B that a shield body 901 comprising a shield panel 903 and an edging 905 (only shown in FIG. 9B) may be provided with different connector types 915A, 915B, 915C, 915D, and that one or more of the connectors may be directed to different sides of the shield (915A1, 915A2), including a lateral side (not shown). Also or alternatively, one or more of the connectors may be interconnected to change connector types such as from one type and/or arrangement of terminals to another type and/or arrangement of terminals, e.g. from male/female pin/receptacle terminals in one arrangement to surface mount terminals in another arrangement. Also or alternatively, one or more of the connectors may be configured and/or interconnected to change signal types, e.g. changing optical to electrical signals and/or changing electrical to optical signals (915C, 915D). Further, a plurality of pairs of screw threaded holes are provided in the edging 905 as mounts 937 between the various connectors 915A, 915B, 915C, 915D.

In another embodiment, which may be without connectors and/or conductors for power and/or signal transfer, the shield body may comprise also or alternatively with one or more mounts for mounting an accessory directed toward a lateral side of the shield body. An accessory may be L- or U-shaped for arranging at least part of the accessory before the threat surface and/or the protected surface of the shield body, by which lateral protrusion of the accessory from the shield body may be reduced.

Figure 10:
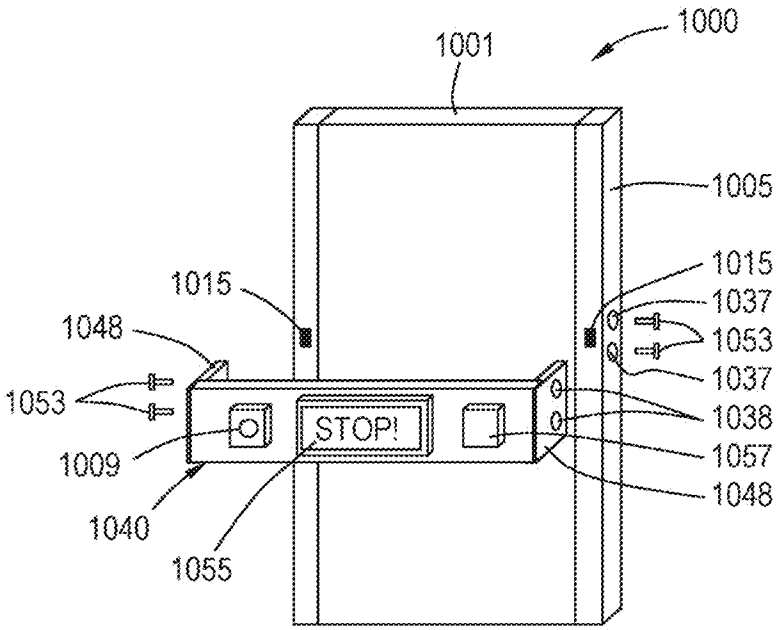
FIG. 10 indicates a further embodiment of a shield system.

As an example of such embodiment, FIG. 10 shows a shield 1000 having a shield body 1001 provided with mounts 1037 accommodated in the edging 1005 of the shield body 1001 for fastening in a lateral direction. The shield 1000 is provided with an expansion bracket 1040 that is generally U-shaped for at least partly gripping around the shield body 1001 and mounting to the mounts 1037 in lateral direction, e.g. using one or more fasteners 1053 and associated mounting portions 1038, such as here in the legs 1048 of the U-shape (e.g. bolts 1053 and through holes 1038). Here also, one or more connectors 1015 of the shield body 1001 and mated counterconnectors of the expansion bracket (not shown) provide operable connection of further optional accessories on the expansion bracket, such as a lamp 1009, a display 1055 for displaying (possibly varying and/or moving) text and/or images on the threat side, and a loudspeaker 1057 from one or more control accessories on the protected side (not shown).

The disclosure is not restricted to the above-described embodiments which can be varied in a number of ways within the scope of the claims.

For instance the shield body may have another shape, like round, oval, square, having a relatively wide lower portion and a relatively narrow top portion. More, fewer and/or differently arranged connectors may be provided. More, fewer and/or differently arranged accessories may be provided. The carrying support a may be shaped and/or sized differently, e.g. according to one or more of size, weight, use conditions, control options, user preference, etc. E.g. for one-handed carrying, two-handed carrying, sling-support and/or user preference etc. The shield may be sized for full body protection of a standing individual, or for torso protection. In some embodiments one or more shields may be shaped rectangular wherein a ratio of the long sides to short sides is 2:1, e.g. being sized like standard DIN paper sizes A0, A1, A2, A3, or A4. Such ratio may simplify scaling protective surface area by combining shields of different sizes. Conformance to DIN A-series sizes may facilitate carrying a shield in a briefcase. An expansion bracket may connect to only a single electrical connector.

Elements and aspects discussed for or in relation with a particular embodiment may be suitably combined with elements and aspects of other embodiments, unless explicitly stated otherwise.

The invention claimed is:

1. A shield system comprising:

a protective shield body, a first accessory and a second accessory, the shield body comprising a shield panel provided with an edging, the shield panel having a first defining a threat side in a threat direction and a second face defining a protected side in a protected direction opposite the threat side and threat direction, respectively and having opposite panel edges, the edging covering at least part of the panel edges, wherein the shield body comprises connectors operably connected with each other, wherein the edging comprises at least one of the connectors, wherein the first and second accessories are operably connectable or connected with each other via the connectors for power and/or signal transfer from the first accessory to the second accessory and/or back via the connectors, and wherein the first accessory is arranged on the threat side and the second accessory is arranged on the protected side.

2. The shield system according to claim 1, wherein at least one of the connectors is arranged on or towards the threat side, and at least one of the connectors is arranged on or towards the protected side.

3. The shield system according to claim 1, wherein at least one of the connectors is at least partly accommodated in the edging.

4. The shield system according to claim 1, wherein power and/or signal conductors operably connected with the connectors are at least partly accommodated in the edging.

5. A shield system comprising:

a protective shield body, a first accessory and a second accessory, the shield body comprising a shield panel provided with an edging, the shield panel having a first face defining a threat side in a threat direction and a second face defining a protected side in a protected direction opposite the threat side and threat direction, respectively and having opposite panel edges, the edging covering at least part of the panel edges, wherein the shield body comprises connectors operably connected with each other, wherein the edging comprises at least one of the connectors, wherein the first and second accessories are operably connectable or connected with each other via the connectors for power and/or signal transfer from the first accessory to the second accessory and/or back via the connectors, and wherein at least part of the edging is overmoulded onto at least part of the connectors.

6. The shield system according to claim 1, wherein the first accessory and/or the second accessory comprise a connector mated to a connector of the shield body.

7. A shield system comprising:

a protective shield body, a first accessory and a second accessory, the shield body comprising a shield panel provided with an edging, the shield panel having a first face defining a threat side in a threat direction and a second face defining a protected side in a protected direction opposite the threat side and threat direction, respectively and having opposite panel edges, the edging covering at least part of the panel edges, wherein the shield body comprises connectors operably connected with each other, wherein the edging comprises at least one of the connectors, wherein the first and second accessories are operably connectable or connected with each other via the connectors for power and/or signal transfer from the first accessory to the second accessory and/or back via the connectors, and wherein at least some of the connectors and at least some conductors operably connecting the at least some of the connectors are configured for power and data transmission.

8. The shield system according to claim 1, wherein the connectors are electrical connectors and the first and second accessories are operably electrically connectable or connected with each other via the connectors for electrical power and/or a signal transfer from the first accessory to the second accessory and/or back via the connectors.

9. A shield system comprising:

a protective shield body, a first accessory and a second accessory, the shield body comprising a shield panel provided with an edging, the shield panel having a first face defining a threat side in a threat direction and a second face defining a protected side in a protected direction opposite the threat side and threat direction, respectively and having opposite panel edges, the edging covering at least part of the panel edges, wherein the shield body comprises connectors operably connected with each other, wherein the edging comprises at least one of the connectors, wherein the first and second accessories are operably connectable or connected with each other via the connectors for power and/or signal transfer from the first accessory to the second accessory and/or back via the connectors, wherein the connectors are electrical connectors and the first and second accessories are operably electrically connectable or connected with each other via the connectors for electrical power and/or a signal transfer from the first accessory to the second accessory and/or back via the connectors, and the shield system further comprising electromagnetic shielding of at least part of the connectors and/or one or more conductors operably connecting the electrical connectors.

10. The shield system according to claim 1, wherein the shield panel comprises one or more power and/or signal conductors operably connected with the connectors.

11. The shield system according to claim 10, wherein the one or more power and/or signal conductors are formed as an at least partly electrically conductive layer operably connected with at least some of the connectors.

12. A shield system comprising:

a protective shield body, a first accessory and a second accessory, the shield body comprising a shield panel provided with an edging, the shield panel having a first face defining a threat side in a threat direction and a second face defining a protected side in a protected direction opposite the threat side and threat direction, respectively and having opposite panel edges, the edging covering at least part of the panel edges, wherein the shield body comprises connectors operably connected with each other, wherein the edging comprises at least one of the connectors, wherein the first and second accessories are operably connectable or connected with each other via the connectors for power and/or signal transfer from the first accessory to the second accessory and/or back via the connectors, wherein the shield panel comprises one or more power and/or signal conductors operably connected with the connectors, and wherein the shield panel comprises a composite panel comprising a compressed stacked laminate of layers wherein at least one of the layers comprises the one or more power and/or signal conductors.

13. The shield system according to claim 9, wherein the shield body comprises one or more mounts for mounting at least one of the first and second accessories onto the shield body.

14. The shield system according to claim 13, wherein the one or more of the connectors and the one or more of the mounts are integrated for mounting and electrically connecting at least one of the first and second accessories onto the shield body.

15. The shield system according to claim 1, wherein at least one of the first and second accessories is formed as an expansion bracket for supporting one or more further accessories.

16. The shield system according to claim 15, wherein the expansion bracket comprises further connectors and one or more further power and/or signal conductors operably connected or connectable with one or more connectors of the shield body.

17. Use of a shield body for operably electrically connecting a first accessory and a second accessory for transferring signals and/or power between the first and second accessories, wherein the shield body comprises a shield panel provided with an edging, the shield panel having a first face defining a threat side in a threat direction and a second face defining a protected side in a protected direction opposite the threat side and threat direction, respectively, and having opposite panel edges, the edging covering at least part of the panel edges, wherein the shield body comprises one or more connectors for power and/or signal transfer from the first accessory to the second accessory and/or back via the connectors transferring the signals and/or power, wherein the edging comprises at least one of the connectors, and wherein the use comprises operably connecting the first and second accessories and transferring the signals from the first accessory to the second accessory and/or back via the connectors, and wherein the first accessory is arranged on the threat side and the second accessory is arranged on the protected side of the shield body.

18. A shield body for a shield system, wherein the shield body comprises a first accessory, a second accessory, and a shield panel provided with an edging, the shield panel having a first face defining a threat side in a threat direction and second face defining a protected side in a protected direction opposite the threat side and threat direction, respectively and having opposite panel edges, the edging covering at least part of the panel edges, wherein the first accessory is arranged on the threat side and the second accessory is arranged on the protected side of the shield body, wherein the shield body comprises one or more connectors for power and/or signal transfer from the first accessory to the second accessory and/or back via the connectors transferring the signal and/or power, wherein the edging comprises at least one of the connectors, and wherein the shield panel comprises one or more power and/or signal conductors operably connected with the connectors for power and/or signal transfer via the connectors, wherein the shield panel comprises a composite panel comprising a compressed stacked laminate of layers, and wherein at least one of the layers comprises the one or more power and/or signal conductors.

19. The shield body according to claim 18, wherein the one or more power and/or signal conductors are formed as an at least partly electrically conductive layer operably connected with at least some of the connectors.

* * * * *